United States Patent [19]

Yamagata et al.

[11] Patent Number: 4,575,598

[45] Date of Patent: Mar. 11, 1986

[54] CIRCUIT BREAKER

[75] Inventors: Shinji Yamagata; Fumiyuki Hisatsune; Junichi Terachi; Kiyomi Yamaoto; Shiro Murata, all of Fukuyama; Hajimu Yoshiyasu, Itami, all of Japan

[73] Assignee: Mitsubishi Denki Kabushiki Kaisha, Tokyo, Japan

[21] Appl. No.: 643,618

[22] PCT Filed: May 1, 1984

[86] PCT No.: PCT/JP84/00224

§ 371 Date: Aug. 14, 1984

§ 102(e) Date: Aug. 14, 1984

[87] PCT Pub. No.: WO85/05217

PCT Pub. Date: Nov. 21, 1985

[51] Int. Cl.[4] ..... H01H 33/08

[52] U.S. Cl. ..... 200/144 C; 200/144 R

[58] Field of Search ..... 200/144 R, 144 C

[56] References Cited

U.S. PATENT DOCUMENTS 4,418,256 11/1983 Graf ..... 200/144 C 4,511,773 4/1985 Heft et al. ..... 200/144 C

*Primary Examiner*—Robert S. Macon

*Attorney, Agent, or Firm*—Wenderoth, Lind & Ponack

[57] ABSTRACT

The present invention relates to a circuit breaker comprising at least a pair of electrical contactors formed of conductors and contacts secured to the conductors for opening or closing an electric circuit in a container, light absorbers having opposed surfaces disposed oppositely to each other from both sides of an arc produced between the contacts at the isolating time, a thermal absorber disposed oppositely to the openings of the opposed surfaces of the light absorbers except the moving trace portion of the electrical contactors, the light absorbers being formed of a composite material having one or more of fiber, net and porous material having more than 35% of apparent porosity selected from composite materials having inorganic series, organic series and composites of the inorganic series and the organic series, and the thermal absorber being formed of a composite material having one or more of an assembly of fine metal wires, porous metals, and a metal plate having a number of pores.

6 Claims, 11 Drawing Figures

CIRCUIT BREAKER

TECHNICAL FIELD

This invention relates to a circuit breaker in which pressure within a container of the breaker is suppressed The term circuit breaker as used in this specification means a current interrupting device which generates an arc in a container, normally a small-sized container such as a circuit breaker, a current limiter or an electromagnetic switch.

BACKGROUND ART

A prior-art circuit breaker will be described below.

FIGS. 1 to 3 are sectional views showing a conventional circuit breaker, wherein FIGS. 1 to 3 show different operating states.

Numeral 1 designates a cover, and numeral 2 a base, which forms an insulating container 3 with the cover 2. Numeral 4 designates a stationary contactor, which has a stationary conductor 5 and a stationary contact 6 at one end of the conductor 5, and the other end of the conductor (not shown). Numeral 7 designates a movable contact 9 disposed oppositely to the contact 6 at one end of the conductor 8. Numeral 10 designates a movable contactor unit, and numeral 11 a movable element arm, which is attached to a crossbar 12 so that each pole is constructed to simultaneously open or close. Numeral 13 designates an arc extinguishing chamber in which an arc extinguishing plate 14 is retained by a side plate 15. Numeral 16 designates a toggle linkage, which has an upper link 17 and a lower link 18. The link 17 is connected at one end thereof to a cradle 19 through a shaft 20 and at the other end thereof to one end of the link 18 through a shaft 21. The other end of the link 18 is connected to the arm 11 of the contactor unit 10. Numeral 22 designates a tiltable operation handle, and numeral 23 an operation spring, which is provided between the shaft 21 of the linkage 16 and the handle 22. Numerals 24 and 25 respectively designate a thermal tripping mechanism and an electromagnetic gripping mechanism, which are respectively defined to rotate a trip bar 28 counterclockwise via a bimetallic element 26 and a movable core 27. Numeral 29 designates a latch, which is engaged at one end thereof with the bar 28 and at the other end thereof with the cradle 19.

When the handle 22 is tilted down to the closed position in the state that the cradle 19 is engaged with the latch 29, the linkage 16 extends, so that the shaft 21 is engaged with the cradle 19, which the result that the contact 9 is brought into contact with the contact 6. This state is shown in FIG. 1. When the handle 22 is then tilted down to the open position, the linkage 16 is bent to isolate the contact 9 from the contact 6, and the arm 22 is engaged with a cradle shaft 30. This state is shown in FIG. 2. When an overcurrent flows in the circuit when the circuit breaker is in the closed state shown in FIG. 1, the mechanism 24 or 25 operates, the engagement of the cradle 19 with the latch 29 is disengaged, the cradle 19 rotates clockwise around the shaft 30 as a center, and is abutted against stop shaft 31. Since the connecting point of the cradle 19 and the link 17 exceeds the operating line of the spring 23, the linkage 16 is bent by the elastic force of the spring 23, each pole automatically cooperatively breaks the circuit via the bar 12. This state is shown in FIG. 3.

The behavior of an arc which is generated when the circuit breaker breaks the current will be described below.

When the contact 9 is contacted with the contact 6, the electric power is supplied sequentially from a power supply side through the conductor 5, the contacts 6 and 9 and the conductor 8 to a load side. When a large current such as a shortcircuiting current flows in this circuit in this state, the contact 9 is isolated from the contact 6 as described before. In this state, an arc 32 is generated between the contacts 6 and 9, and an arc voltage is produced between the contacts 6 and 9. Since this arc voltage rises as the distance from the contact 6 to the contact 9 increases the arc 32 is tripped by the magnetic force toward the plate 14 to be extended, and the arc voltage is further raised. In this manner, the arc current approaches the current zero point, thereby extinguishing the arc to complete the breakage of the arc. The huge injected arc energy eventually becomes thermal energy, and is thus dissipated completely out of the container, but transiently rises the gas temperature in the small container and accordingly causes an abrupt increase in the gas pressure. This causes a deterioration in the insulation in the circuit breaker and an increase in the quantity of discharging spark escaping from the breaker, and it is thereby feared that an accident of a power source shortcircuit or damage to the circuit breaker body will occur.

The mechanism of the arc energy consumption based on the creation of the present invention will be described below.

FIG. 4 is a view in which an arc A is produced between contactors 4 and 7. In FIG. 4, character T designates a flow of thermal energy which is dissipated from the arc A through the contactors, character the flows of the energy of metallic particles which are released from the arc space, and character R the flows of energy caused by light which is irradiated from the arc space. In FIG. 4, the energy injected into the arc A is generally consumed by the flows T, m and R of the above three energies. The thermal energy T which is conducted to electrodes of these energies is extremely small, and most of the energies are carried away by the flows m and T. In the mechanism of the consumption of the energy of the arc A, it has heretofore been considered that the flows m in FIG. 4 are almost all of these energizes, and the energy of the flows R is substantially ignored, but it has been clarified by the recent studies of the present inventors that the consumption of the energy of the flows R and hence the energy of light is so huge as to reach approx. 70% of the energy injected to the arc A.

In other words, the consumption of the energy injected to the arc A can be analyzed as below.

$$P_W = V \cdot I = P_K + Pth + P_R$$

$$P_K = \tfrac{1}{2} m V^2 + m \cdot C_p \cdot T$$

where $P_W$: instantaneous injection energy

V: arc voltage

I: current

V·I: instantaneous electric energy injected into the arc $P_K$: quantity of instantaneous energy which is carried by the metallic particles of mg scattering at a speed v $m \cdot C_p \cdot T$: quantity of instantaneous energy carried away by the gas (the gas of the metallic particles) of constant-pressure specific head $C_p$ pth: quantity of instantaneous energy carried away from the arc space to the contactor via thermal conduction $P_R$: quantity of instantaneous energy irradiated directly from the arc via light The above quantities vary according to the shape of the contactors and the length of the arc. When the length of the arc is 10 to 20 mm, $P_K=10$ to 20%, pth=5%, and $P_R=75$ to 85%.

The state in which the arc A is enclosed in the container 3 is shown in FIG. 5. When the arc A is enclosed in the container 3, the space in the container 3 is filled with the metallic particles and reaches a high temperature. The above state is strong particularly in the gas space Q (the space Q designated by hatched lines in FIG. 5) in the periphery of the arc positive column A. The light irradiated from the arc A is irradiated from the arc positive column A to the wall of the container 3, and is reflected at the wall. The reflected light is scattered, is passed again through the high temperature space in which the metallic particles are filled, and is again irradiated to the wall surface. Such reflections are repeated until the quantity of light becomes zero. The path of the light in this case is shown by Ra, Rb, Rc and Rd in FIG. 5.

The consumption of the light irradiated from the arc A is by the following ways.

(1) Absorption at the wall surface (2) Absorption by the arc space and peripheral (high temperature) gas space and hence by the gas space The light irradiated from the arc includes wavelengths from far ultraviolet rays less than 2000 Å to far infrared rays more than 1 $\mu$m including all wavelengths in the range of continous spectra and linear spectra. The wall surface of the general container has a light absorption capability only in the range of approx. 4000 Å to 5500 Å even if the surface is black, and partly absorbs in the other range, but mostly reflects. However, the absorptions in the arc space and the peripheral high temperature gas space are as below.

When the light of wavelength $\lambda$ is irradiated to the gas space having a length L, and uniform composition and temperature, the quantity of light absorption by the gas space can be calculated as below.

$$Ia - A \cdot n \cdot LIin \quad (1)$$

where

Ia: absorption energy by gas

Ae: absorption probability

Iin: irradiated light energy n: particle density

L: length of light path of the light

However, the formula (1) represents the quantity of absorption energy for a special wavelength $\lambda$. The term Ae is the absorption probability of the special wavelength $\lambda$, and is a function of the wavelength $\lambda$, gas temperature and type of the particles.

In the formula (1), the absorption coefficient becomes the largest value for the gas the same as the light source gas for irradiating the light (i.e., the type and the temperature of the particles are the same) in both the continuous spectra and the linear spectra according to the teaching of the quantum mechanics. In other words, the arc space and the peripheral gas space absorb most of the light irradiated from the arc space.

In the formula (1), the quantity Ia of the absorption energy of the light is proportional to the length L of the light path. As shown in FIG. 5, when the light from the arc space is reflected at the wall surface, the L in the formula (1) is increased by the number of reflections of the light, and the quantity of the light energy absorbed at the high temperature section of the arc space is increased.

This means that the energy of the light irradiated by the arc A is eventually absorbed by the gas in the container 3, thereby raising the gas temperature and accordingly the gas pressure.

It the present invention, in order to effectively absorb the energy of the light which reaches approx. 70% of the energy injected into the arc, a special material is used in in which that one or more types fiber, net and highly porous material having more than 35% of porosity for effectively absorbing the light irradiated from the arc are selectively disposed at a special position for receiving the energy of the light of the arc in the container of the circuit breaker, thereby absorbing a great deal of the light in the container to lower the temperature of the gas space and to lower the pressure.

The above-described fiber is selected from an inorganic series of materials, metals, composite materials, woven materials and non-woven fabric, and is required to have thermal strength since it is installed in the space which is exposed to the high temperature arc.

Of the above-described materials of the fiber and the net, the inorganic series of materials adaptively include ceramic, carbon, asbestos, and the optimum metals include Fe, Cu, and may include plated Zn or Ni.

The highly porous blank generally has materials of the ranges of metals, inorganic series and organic series of the materials which have a number of fine holes in a solid structure, and are classified according to the relationship between the material and the fine holes into material which contains as a main body sold particles sintered and solidified at the contacting points therebetween and material which contains in a main body holes in such a manner that the partition walls forming the holes are solid material. In the present invention, the blank means the material before it is machined to a concrete shape, so-called "a material".

When the blanks are further more particularly classified, the blanks can be classified into the blank in which the gaps among the particles exists as fine holes, the blanks in which the gaps among the articles commonly exist as fine holes in the particles, and the blanks which contain foamed holes therein. The blanks are largely classified into the blank which has air permeability and water permeability, and the blanks which have individual pores independent of each other having no air permeability.

The shape of the above fine holes is very complicated and is largely classified into open holes and closed holes, the structures of which are expressed by the volume of the fine holes or porosity, the diameter of the fine holes and the distribution of the diameters of the fine holes and specific surface area.

The true porosity is expressed by the void volume which is the fine hole volume of all the open and closed holes contained in the porous blank with respect to the total volume (bulk volume) of the blank, i.e., percentage, which is measured by a substitution method and an absorption method with liquid or gas, but can be calculated as described below as defined in the method of measuring the specific weight and the porosity of refractory heat insulating brick of JIS R 2614 (Japanese Industrial Standard, the Ceramic Industry No. 2614).

$$\text{True porosity} = \left(1 - \frac{\text{Bulk specific weight}}{\text{True specific weight}}\right) \times 100\%$$

The apparent porosity is expressed by the void volume which is the volume of the open holes with respect to the total volume (bulk volume) of the blank, i.e., percentage, which can be calculated as described below as defined by the method of measuring the apparent porosity, absorption rate and specific weight of a refractory heat insulating brick of JIS R 2205 (Japanese Industrial Standard, the Ceramic Industry No. 2205). The apparent porosity may also be defined as the effective porosity.

$$\text{Apparent porosity} = \frac{\text{Water weight} - \text{dry weight}}{\text{Water weight} - \text{underwater weight}} \times 100\%$$

The diameter of the fine holes is obtained by the measured values of the volume of the fine holes and the specific surface area, and includes several Å (Angstrom) to several mm from the size near the size of an atom or ion to the boundary gap of the particles group, and which is generally defined as the mean value of the distribution. The diameter of the fine holes of the porous blank can be obtained by measuring the shape, size and distribution of the pores with a microscope, or by a mercury press-fitting method. In order to accurately know the shape of the pores, it is generally preferable to employ a microscope as a direct method.

The measurement of the specific surface area is performed frequently by a BET method which obtains the area by utilizing adsorption isothermal lines in the respective temperatures of various adsorption gases, and nitrogen gas is frequently used.

The patterns of the absorption of the energy of the light and the decrease of the gas pressure by the adsorption using the special material of the present invention will be described in connection with an example of an inorganic porous material.

FIG. 6 is a perspective view showing an inorganic porous blank, and FIG. 7 is an enlarged fragmentary sectional view of FIG. 6. In FIGS. 6 and 7, numeral 13 designates an inorganic porous blank, and numeral 34 open holes communicating with the surface of the blank. The diameters of the hole 34 are distributed in the range from several microns to several mm in a random manner.

When the light is incident to the hole 34 when the light is incident to the blank 33 as designated by R in FIG. 7, the light is irradiated to the wall surface of the blank, is then reflected on the wall surface, is reflected in multiple ways in the hole and is eventually absorbed 100% by the wall surface. In other words, the light incident to the hole 34 is absorbed directly by the surface of the blank, and becomes heat in the hole.

FIG. 8 shows a characteristic curve diagram of the variation in the pressure in a model container in which the inorganic porous material is placed when the apparent porosity of the material is varied. In FIG. 8, the abscissa is the apparent porosity, and the ordinate expresses the pressure with the pressure when the porosity is 0 being that when the inner wall of the container is formed of metal such as Cu, Fe or Al and being set as 1 as a reference. As the experimental conditions, AgW contacts are installed at a predetermined gap of 10 mm in a sealed container in the shape of a cube 10 cm on each side, an arc of sinusoidal wave current of 10 kA peak value is produced for 8 msec, and the pressure in the container produced by the energy of the arc is measured.

The inorganic porous material used in the above embodiment is porous porcelain which is prepared by forming and sintering cordierte as the raw material of the porcelain of to which has been added inflammable material or foaming agent thereto to from the porous material, which has five holes with a mean diameter of 10 to 300 microns. Blanks having apparent porosites of 20, 30, 35, 40, 45, 50, 60, 70, 80 and 85% and the size of 50 mm×50 mm×4 mm (thickness) were prepared and disposed on the wall surface of the container to cover 50% of the surface area of the inner surface of the container.

The diameter of the fine holes should be a mean diameter which slightly exceeds the range of the wavelength of the light to be absorbed, and the rate of the fine holes occupying the surface, i.e., the degree of the specific surface area of the fine holes is important. In the absorption of the light in the fine holes, the deep holes are more effective and communicating pores are preferable. Since the light irradiated by the switch from the arc A is distributed in the range of several hundreds Å to 10000 Å (1 μm), fine holes of several thousands Å to several 1000 μm of mean diameter, which slightly exceeds the above wavelengths, are adequate, and a highly porous material which exceeds 35% apparent porosity in the area of the holes occupying the surface is good for absorbing the light irradiated from the arc A. The effect can be particularly increased when the upper limit of the diameter of the fine holes is in the range less than 1000 m and the specific surface area of the fine holes is larger. According to the experiments, it has been confirmed that a preferred absorbing characteristic can be obtained to the light irradiated from the arc in a material having a mean diameter of five holes in the range of 5 μm to 1 mm. It has also been observed that a blank of glass having holes in the range of 5 or 20 μm mean diameter absorbs the light irradiated from the arc A well.

As seen from the characteristic curve in FIG. 8, the pores of the inorganic porous material absorbs the light energy, and acts to lower the pressure in the circuit breaker, which reduction increases as the apparent porosity of the porous blank is increased, and increases remarkably as the porosity becomes larger than 35%, and continues in the range up to 85%. When the porosity is further increased, it is necessary to further increasing the thickness of the porous material.

When the porosity is increased the relationship between the apparent porosity and the mechanical strength of the porous blank is such that the blank becomes brittle, the thermal conductivity of the blank decreases, and the blank becomes readily fusible by the high heat. When the porosity is decreased, the effect of reducing the pressure in the circuit breaker is reduced. Accordingly, the optimum apparent porosity of the porous blank for the practical use is in the range of 40 to 70% which is highly porous material.

The characteristic trend of FIG. 8 can also be applied to the general inorganic porous materials, and this can be assumed from the above description as to the absorption of the light.

Some prior-art circuit breakers use the inorganic material, but the object is mainly to protect the organic material container against the arc A, and the necessary characteristics include arc resistance, lifetime, thermal conduction, mechanical strength, insulation and carbonization resistance. The inorganic material which satisfies these requirements is composed of a material which has a relatively low porosity, and the purpose is different from the object of the present invention, and the apparent porosity of the prior-art material is approx. 20%.

The highly porous blanks are made of materials from the inorganic, metallic and organic series, of materials and the inorganic materials are particularly characterized as having insulation and high melting point properties. These two characteristics are useful for the material to be installed in the container of the circuit breaker. In other words, since the blank is electrically insulating, which does have an adverse influence an the breakage, and since the blank has a high melting point, the blank does not become molten nor produce gas, even if the blank is exposed to high temperature, and the blank is optimum as a pressure suppressing material.

The inorganic porous material can be porous porcelain, refractory material, glass, and cured cement, all of which can be used to decrease the gas pressure in the circuit breaker.

DISCLOSURE OF THE INVENTION

In this invention light absorbers and a thermal absorber are provided in the circuit breaker so that the internal pressure in a container therefor can be effectively decreased and the cost thereof can be reduced to enhance the safety and reliability of the circuit breaker.

BRIEF DESCRIPTION OF THE DRAWINGS

In the drawings, the same symbols indicate the same or equivalent parts.

BEST MODE FOR CARRYING OUT THE INVENTION

Figure 1:
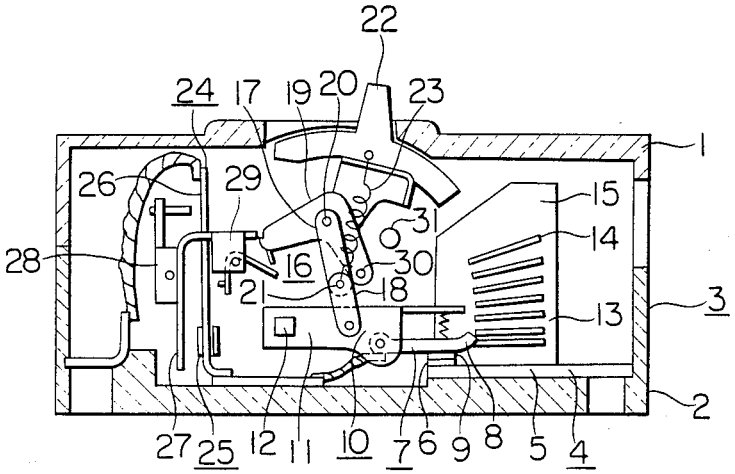
FIGS. 1 to 3 are fragmentary sectional front views showing a prior-art circuit breaker in different operation states.
Figure 2:
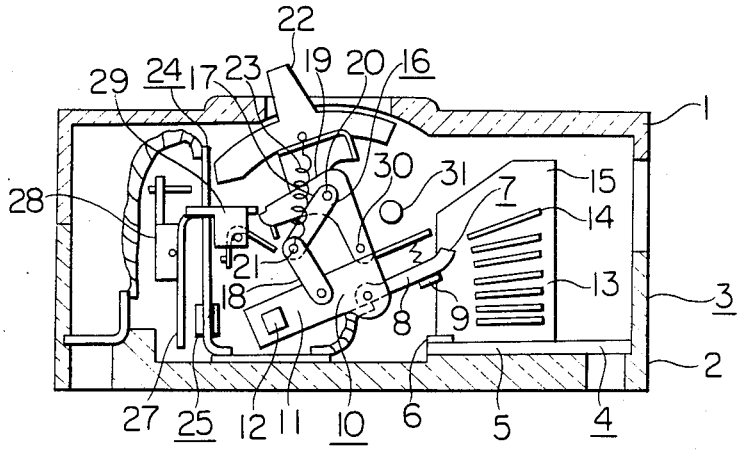
Figure 3:
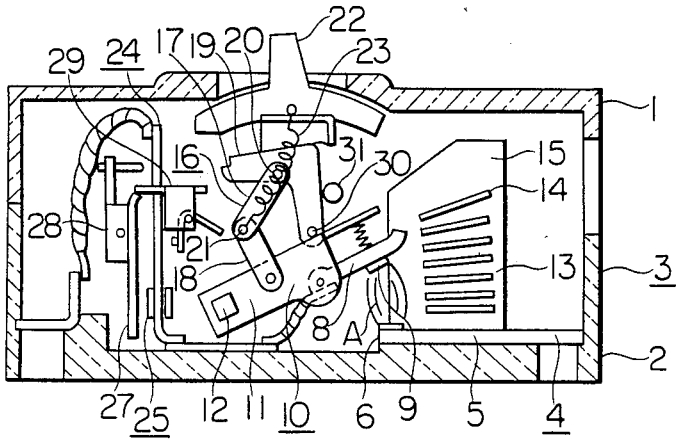
Figure 4:
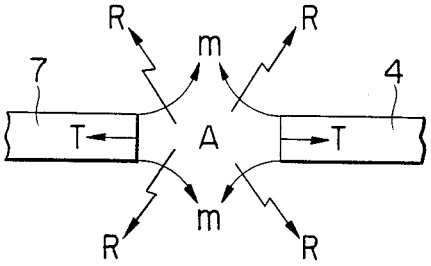
FIG. 4 is a view for explaining the flow of an arc produced between the contactors.
Figure 5:
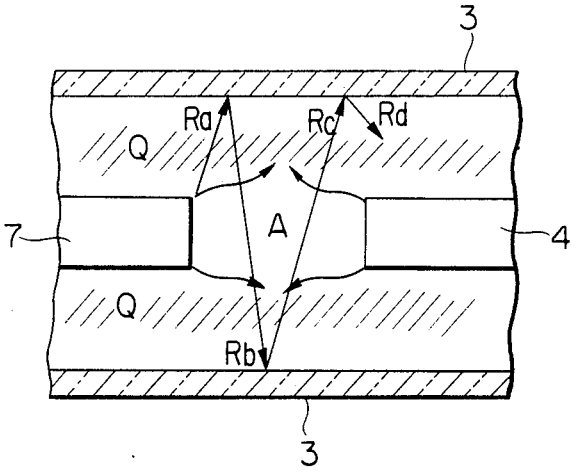
FIG. 5 is a view for explaining the state when the arc is produced between the contactors in a container.
Figure 6:
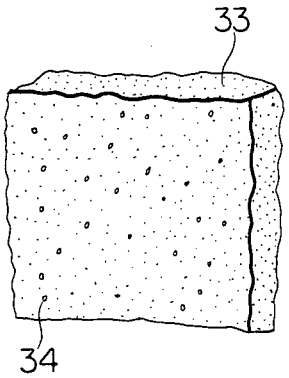
FIG. 6 is a perspective view showing an inorganic porous material.
Figure 7:
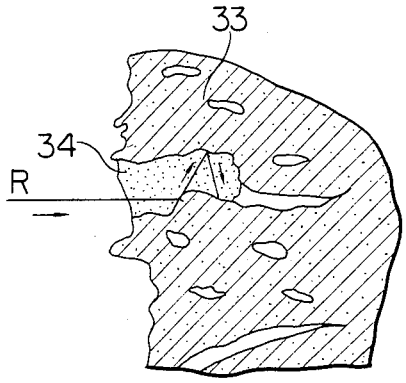
FIG. 7 is an enlarged fragmentary sectional view of part of the material shown in FIG. 6.
Figure 8:
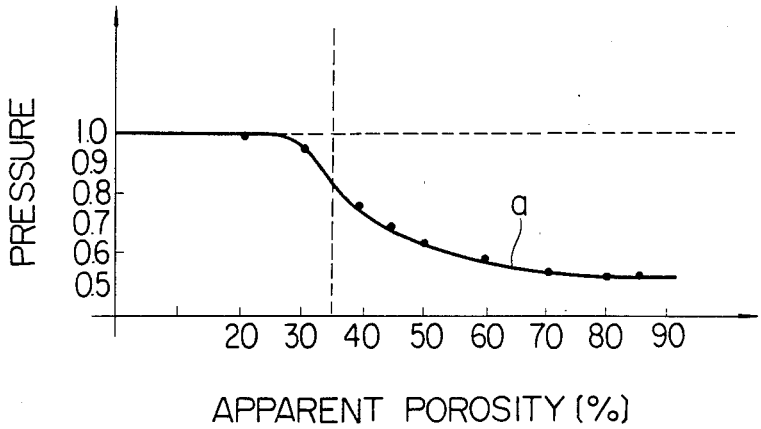
FIG. 8 is a characteristic curve diagram for showing the relationship between the apparent porosity of the inorganic porous material and the pressure in the container for containing the material.
Figure 9:
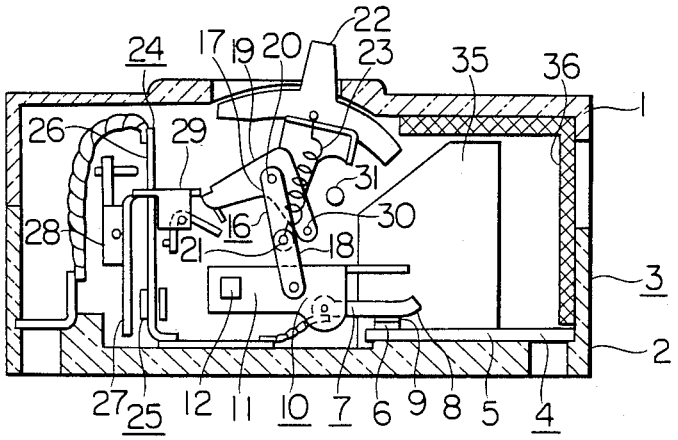
FIG. 9 is a fragmentary sectional front view of a circuit breaker according to an embodiment of the present invention.
Figure 10:
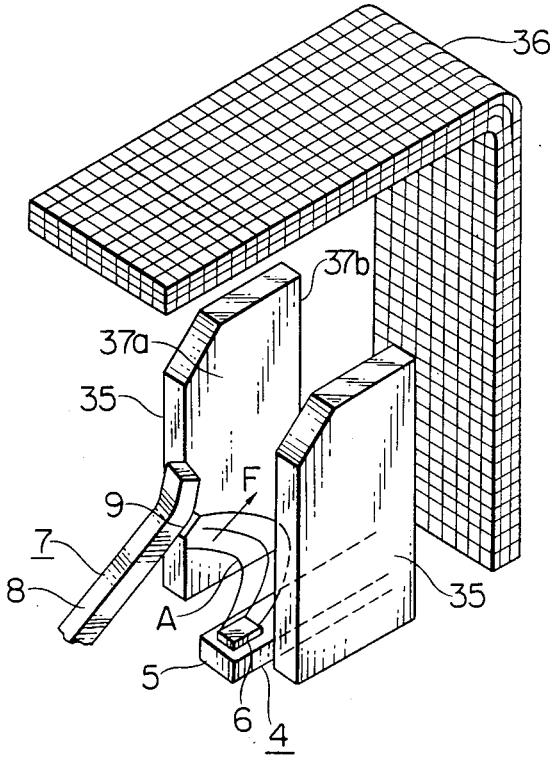
FIG. 10 is a perspective view of the essential portion of the circuit breaker.

FIG. 9 is a fragmentary side view of first embodiment of the circuit breaker according to the present invention, and FIG. 10 is a perspective view of the essential portion of the circuit breaker.

In FIGS. 9 and 10, numeral 4 designates a stationary contactor, in which a stationary contact 6 is fixed to the upper surface of the end of a stationary conductor 5. Numeral 7 designates a movable contactor, in which a movable contact 9 contacting with or separating from the stationary contact 6 is fixed to the lower surface of the end of a movable conductor 8. Numerals 35 indicate a light absorber means having two sheets, which are selected from an inorganic material, an organic material and a composite material of inorganic and organic materials and being in the form of one or more of fiber, net and porous material and having more than 35% apparent porosity. The light absorbers 35 are disposed on opposite sides of an arc A produced between the movable contact 9 and the stationary contact 6 when the movable contactor 7 is isolated from the stationary contactor 4. Numeral 36 designates a thermal absorber having an inverted L shape, which is disposed oppositely to the upper opening 37*a* and the rear opening 37*b* between the opposed surfaces of the light absorbers 35 other than the path of movement of the movable contactor 7. The thermal absorber 36 is formed of a composite material which is a blank formed from one or more fine metal wires of metals such as copper, iron, stainless steel, aluminium and nickel or their alloys, a porous material and a metal plate having a number of pores. The other structure is similar to the prior-art device, and a description is omitted for brevity.

The operation of the above embodiment constructed as described above will be described.

When the movable contactor 7 is separated from the stationary contactor 4, the arc A is produced between the movable contact 9 and the stationary contact 6. Since the light absorbers 35 are disposed at a position nearest the arc A, the above-described effect for absorbing the energy of the light irradiated and which is a pressure generation source can be efficiently performed. Because the light absorbes 35 are installed at the side of the contact, with a very large stereoscopic angle for receiving the energy of the light irradiated from the arc A, they remarkably reduce the internal pressure in the container at the breaking time. As a result, damage to the molded container at the breaking time which occurs in the prior-art circuit breaker can be eliminated, thereby making it possible to reduce the mechanical strength of the container 3 formed of a cover 1 and a base 2. Thus, the quantity of the molding material for forming the cover 1 and the base 2 can be greatly reduced, and the cost of the cover 1 and the base 2 can be decreased by using an inexpensive grade of material having lower mechanical strength as the material for the cover 1 and the base 2. Further, the quantity of the spark of the arc discharge from the container 3 at the breaking time can be reduced due to the decrease in the internal pressure of the container, and a secondary defect such as a short-circuiting accident at the power source side at the current breaking time can be prevented. In addition, the temperature of the arc can be decreased as the internal pressure in the container is reduced, and since the arc 1 is interposed between the light absorbers 35, the decrease in the resistance between the power source loads and the decrease in the resistance between the phases caused by the evaporation of molten metal or insulator in the vicinity of the arc which occurs in the conventional circuit breaker can be prevented, thereby improving the safety and the reliability of the circuit breaker.

Since the thermal absorber 36 is disposed oppositely to the openings 37*a* and 37*b* between the light absorbers 35, the molten materials of the contacts 6, 9 and the conductors 5, 8 exhausted toward the openings 37*a*, 37*b* are adhered to the thermal absorber 36, thereby improving the resistance between the contacts and the phases after the breakage.

Further, since the thermal absorber 36 actuates the high temperature gas through the light absorbers 35, the leg of the arc A is hardly formed directly on the thermal absorber 36, the disadvantages caused by the formation of the leg of the arc, i.e., the decrease in the arm voltage caused by the evaporation of the molten thermal absorber 36, the decrease of the resistance, can be obviated, but the absorption of the light energy and the thermal energy which cannot be sufficiently absorbed by the light absorbers 35, 36 and the thermal absorber 36 having a large surface area and high thermal conductivity can be supplemented, thereby accelerating the decrease in the internal pressure in the container.

Figure 11:
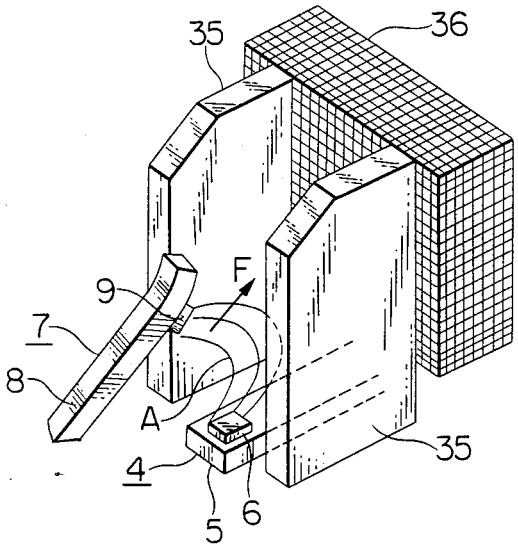
FIG. 11 is a perspective view of the essential portion of the circuit breaker according to another embodiment of the present invention.

FIG. 11 shows second embodiment of the present invention, in which a thermal absorber 36 is installed only on the back surface between light absorbers 35.

When an inorganic porous material mainly of magnesia or zirconia is used as the blank for the light absorbers 35, the light absorbers are not vitrified even if the arc is irradiated directly on the surfaces of the light absorbers, but they are crystallized. Thus, the resistance on the surfaces of the light absorbers does not decrease during the arcing period, thereby obtaining preferable breaking performance. In addition, when the surface of the inorganic porous material is hardened by a heat treatment or an organic material is suitably combined with the inorganic porous material, the precipitation of powder from the light absorbers 35 due to the vibration impact of the circuit breaker can be prevented without any great effect on of the decrease in the internal pressure in the container.

INDUSTRIAL APPLICABILITY

According to the present invention as described above, the internal pressure of the container can be effectively decreased and the cost can be reduced while the safety and the reliability of the circuit breaker of the present invention can be increased by providing the light absorbers and the thermal absorber in the circuit breaker.

We claim:

1. A circuit breaker with an arc light absorber and a thermal absorber, and comprising:

a pair of electric contactors contained in an insulating container for opening or closing an electric circuit;

electric conductors extending to said electric contactors and contacts on said conductors;

a pair of side walls provided on both sides of said contactors in spaced opposed relation to each other and having a size for absorbing light from the arc formed when said contactors open and close;

said side walls being formed of a heat resistant, electrically insulating, light absorbing material having more than 35% apparent porosity; and a thermal absorber disposed opposite the opening between the opposed surfaces of said light absorbing side walls at locations other than the path of movement of said electric contactors, said thermal absorber being of a composite material of at least one material taken from the group consisting of an assembly of fine metal wires, porous metals, and a metal plate having a plurality of pores therein.

2. A circuit breaker as claimed in claim 1 in which said light absorbing side walls are of a composite material taken from the group consisting of fiber, net and porous material, the composition of said composite material being a material taken from the group of material from the inorganic series of materials, material from the organic series of materials, and materials which are composites thereof.

3. A circuit breaker according to claim 1 in which the surface of said light absorbing side walls having a heat treatment hardened surface.

4. A circuit breaker as claimed in claim 1 in which said light absorbing material is a material mainly containing magnesia or zirconia.

5. A circuit breaker as claimed in claim 2 in which said light absorbing material is a material mainly containing magnesia or zirconia.

6. A circuit breaker as claimed in claim 3 in which said light absorbing material is a material mainly containing magnesia or zirconia.

* * * * *